US005119797A

United States Patent [19]

Anderson

[11] Patent Number: 5,119,797

[45] **Date of Patent: * Jun. 9, 1992**

[54] ARCHERY DEVICE AND ARROW

[76] Inventor: Jeffrey R. Anderson, 162 Slocum Lake Rd., Wauconda, Ill. 60084

[ * ] Notice: The portion of the term of this patent subsequent to Sep. 25, 2007 has been disclaimed.

[21] Appl. No.: 555,190

[22] Filed: Jul. 18, 1990

Related U.S. Application Data

[63] Continuation-in-part of Ser. No. 327,769, Mar. 23, 1989, Pat. No. 4,958,617, which is a continuation-in-part of Ser. No. 80,019, Jul. 31, 1987, Pat. No. 4,829,974.

[51] Int. Cl.[5] ..... F41B 5/00; A63B 65/02

[52] U.S. Cl. ..... 124/25; 124/24.1; 124/44.5; 124/86; 273/416

[58] Field of Search ..... 124/23.1, 24.1, 25, 124/25.5, 25.6, 26, 27, 41.1, 44.5, 82, 83, 84, 86, 88; 273/416–423

[56] References Cited

U.S. PATENT DOCUMENTS

| | | | |
|---|---|---|---|
| 2,212,345 | 8/1940 | Krieger | 273/420 |
| 2,443,395 | 6/1948 | Lutins | 273/420 X |
| 3,538,901 | 11/1970 | Switack | 124/25 |
| 3,788,299 | 1/1974 | Mathews | 124/25 X |
| 4,266,782 | 5/1981 | Patterson | 273/423 |
| 4,565,182 | 1/1986 | Barnett | 124/25 |
| 4,688,539 | 8/1987 | Lawrence | 124/27 |
| 4,696,281 | 9/1987 | Nishioka | 124/25 |
| 4,796,598 | 1/1989 | Jones | 124/25 |
| 4,827,893 | 5/1989 | Nishioka | 124/25 |
| 4,947,822 | 8/1990 | Jones et al. | 124/41.1 |
| 4,958,617 | 9/1990 | Anderson | 124/24.1 |

FOREIGN PATENT DOCUMENTS

| | | | |
|---|---|---|---|
| 8607135 | 12/1986 | World Int. Prop. O. | 124/24.1 |

*Primary Examiner*—Peter M. Cuomo
*Assistant Examiner*—John Ricci
*Attorney, Agent, or Firm*—Lockwood, Alex, FitzGibbon & Cummings

[57] ABSTRACT

A kit for assembly and attachment to a crossbow that will adapt the cross bow to shoot arrows (e.g. 6 inches long) which are several times shorter than arrows of conventional length (e.g. 22 inches) normally shot by a crossbow. The kit includes an elongated track or guide assembly through which a short arrow is guided as it is being launched. The track assembly is mounted on the stock of a crossbow by a front clamp which supports the muzzle end of the track assembly and a rear receiver which supports the breech end of the track assembly. A short arrow loaded from the muzzle end into the breech end of the track assembly is releaseably retained in place against premature dislodgment by gravity or otherwise by a spring which presses an arrow shaft-engaging shoe into retaining engagement with the shaft of the arrow. The invention also comprises the short arrow adapted to be launched and shot from a crossbow equipped with the kit.

14 Claims, 2 Drawing Sheets

ARCHERY DEVICE AND ARROW

This invention is a continuation-in-part of application Ser. No. 07/327,769 filed Mar. 23, 1989 now U.S. Pat. No. 4,958,617, which was a continuation-in-part of application Ser. No. 80,019 filed Jul. 31, 1987 issued as U.S. Pat. No. 4,829,974 on May 16, 1989.

This invention relates to new and useful improvements in crossbows and arrows therefore. More particularly, the invention relates to such improvements in the form of a kit which is adapted to be assembled and mounted on the stock of a conventional crossbow so as to convert the crossbow from one which shoots arrows of conventional length to one which shoots arrows which are several times shorter than conventional arrows.

The object of the invention generally stated is a provision of a kit which is relatively inexpensive to mass produce and which may be readily assembled and mounted on the stock of a conventional crossbow so as to enable the crossbow to be used to launch and shoot arrows which are several times shorter than conventional.

An important further object of the invention is the provision of such a kit which upon being removed from the stock of a crossbow restores the crossbow to its original condition and allows it to be used to shoot arrows of conventional length.

Another important object of the invention is the provision of short arrows which are particularly adapted to be launched and shot from a crossbow on which a kit embodying the invention has been installed.

A still further object of the invention is to provide crossbows which as originally constructed are equipped and designed to shoot short arrows so that the features of the kits provided by the present invention are permanently incorporated and designed into the crossbows as originally manufactured.

Certain other objects of the invention will be apparent to those skilled in the art in the view of the following detailed description of the kit and arrow embodiments of the invention taken in connection with the accompanying drawings wherein.

Figure 6:
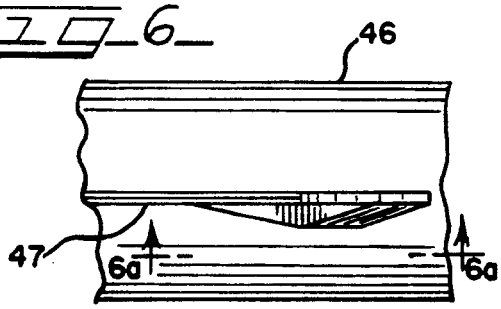
FIG. 6 is a fragmentary view on enlarged scale showing a detail of the arrow shown in FIG. 5.
Figure 6A:
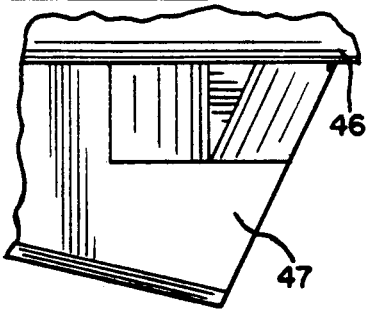

FIG. 6*a* is a fragmentary detail view taken on line 6*a*—6*a* of FIG. 6.

Figures 1, 2, 3, 8:
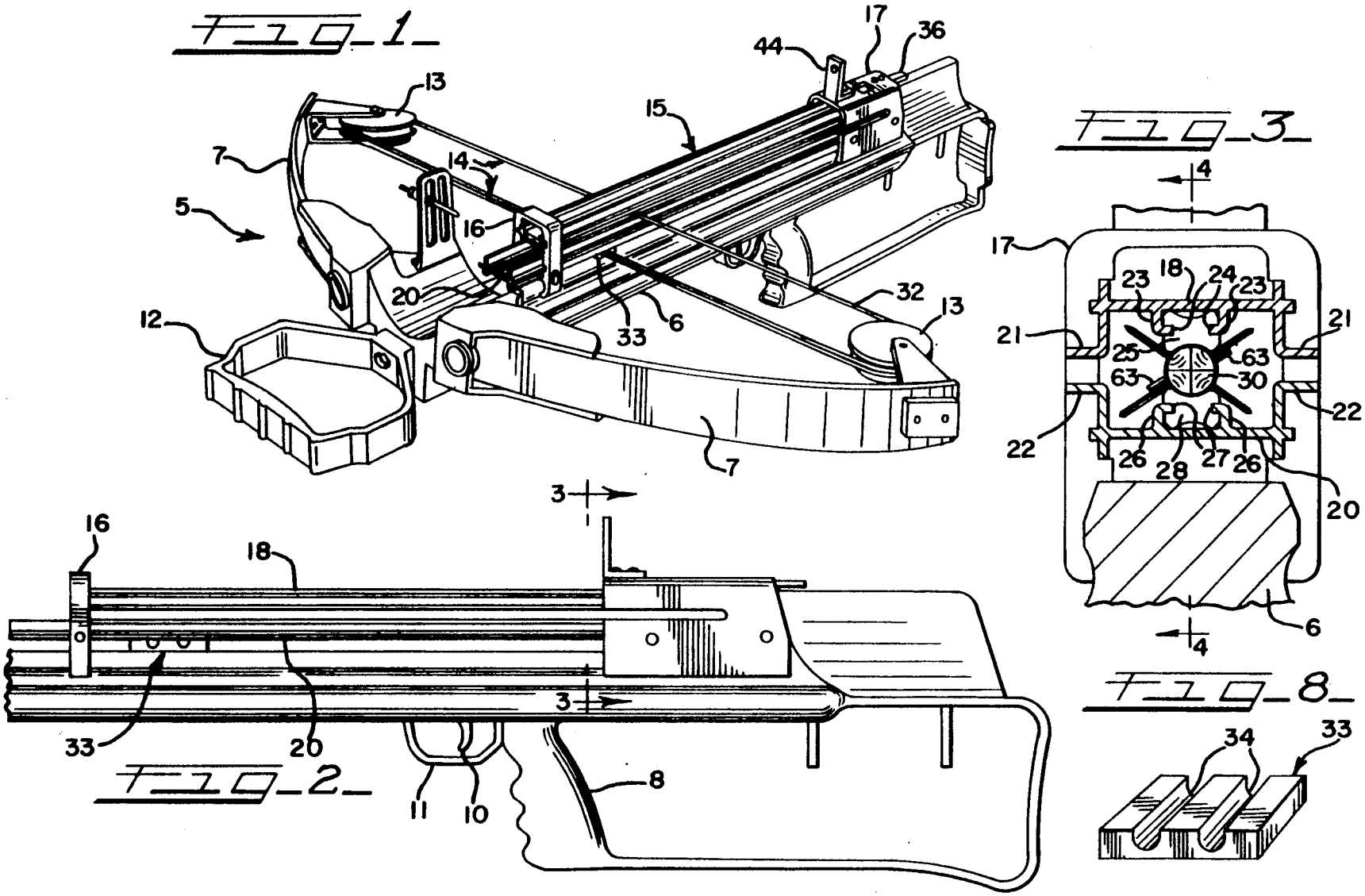
FIG. 1 is a perspective view of a conventional commercially available crossbow on which has been assembled and mounted a kit embodying the present invention and which enables the crossbow to shoot short arrows which are several times shorter than the arrows normally shot by the crossbow.
FIG. 2 is a fragmentary side elevation on enlarged scale of the embodiment shown in FIG. 1.
FIG. 3 is a fragmentary detail sectional view on enlarged scale taken on line 3—3 of FIG. 2.
Figure 5:
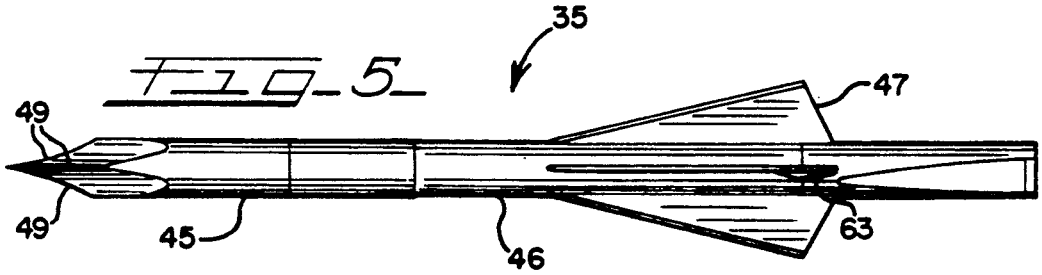
FIG. 5 is a full scale view of a short arrow forming another embodiment of the invention and adapted to be shot or fired from the kit equipped crossbow of FIGS. 1–4.
Figure 7:
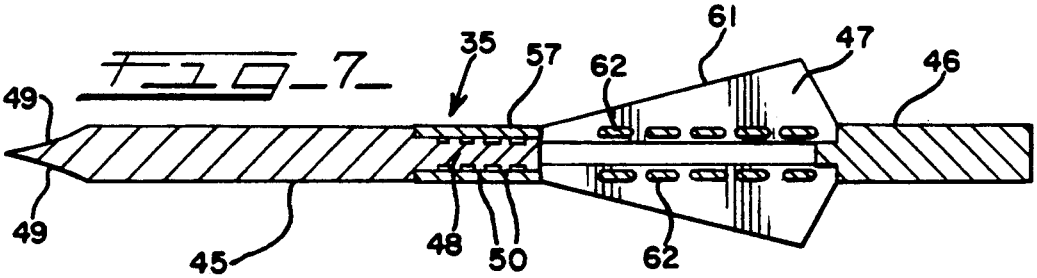

FIG. 7 is a longitudinal sectional view of the arrow shown in FIG. 5; and FIG. 8 is a perspective view of a cable slide.

A conventional crossbow is indicated generally at 5 in FIG. 1 being in particular a STARFIRE II model crossbow commercially available from P.S.E., Inc. of Tucson, Ariz. It will be understood that the crossbow 5 is representative of other commercially available crossbows.

The crossbow has a conventional construction and comprises a stock 6 to the front end of which are mounted bow limbs 7-7. The butt of the stock 6 is equipped with a pistol grip 8 at the rear of the trigger 10 and trigger guard 11. A stirrup 12 is mounted on the front end of the stock 6 to receive the archer's foot when the crossbow 5 is being cocked. Pulleys 13-13 are mounted on the distal ends of the limbs 7 and to which the cable 14 is attached in the usual manner.

The crossbow 5 is converted from shooting conventional long arrows to shooting short arrows by assembling and mounting thereon a conversion kit which is indicated generally at 15. The short arrow firing kit 15 comprises a front mounting clamp 16 and a rear receiver 17 which support therebetween an upper track 18 and lower track 20 (FIG. 3). The upper and lower tracks 18 and 20 are preferably cut to the desired lengths from an elongated extrusions of aluminum but may be formed of other suitable rigid materials and/or by different production techniques. As shown in FIG. 3, the tracks 18 and 20 have the same or symmetrical cross-sections with upper track 18 inverted with respect to the lower track 20. As shown in FIG. 1, the lower track 20 may be somewhat longer than the upper track 18 for ease and safety in loading an arrow. The upper track 18 has side flanges 21-21 while the lower track 20 has corresponding side flanges 22-22. At their opposite ends the side flanges 21 and 22 are reduced in width so as to be received and fit in grooves provided therefor in the inverted U-shaped front clamp 16 and rear receiver 17 as shown in FIG. 3.

On its interior, the upper track 18 has a pair of spaced, longitudinally extending, hook-like formations 23-23 with inturned flanges 24-24. The flanges 24 serve to support an elongated arrow guide strip 25 formed of a low friction material such as a high density or ultra-high molecular weight polyethylene or other suitable plastic having similar properties. The arrow guide strip 25 is retained in place by means of the flanges 24 projecting into longitudinal slots formed into the opposite sides of the guide strip 25.

The lower track 20 is similarly provided with elongated longitudinally extending hook-like formations 26-26 which have inwardly extending flange portions 27-27 which serve to support a lower arrow guide strip 28.

The guide strips 25 and 28 are symetrical and have lower and upper surfaces which are arcuate and preferably have approximately the same radius of curvature as the exterior cylindrical surface of the shaft of arrow 30 disposed therebetween as shown in FIG. 3. Since the guide strips 25 and 28 are symetrical, on being removed from their respective support tracks 18 and 20, they may be inverted and replaced to present a second set of arcuate arrow-engaging wear surfaces.

The short arrow adapter kit 15 makes use of the trigger mechanism with which the crossbow 5 was equipped as manufactured. As is well understood by those skilled in the art when the trigger 10 is squeezed it acts through a conventional linkage (not shown) to retract a cocked bow string retainer pin 31 (FIG. 4) so as to release the bow string 32 (FIG. 4) and fire an arrow. The bow string 32 moves in the space or clearance between the arrow guide strips 25 and 28 while the remaining two lengths of the cable 14 move in the space or clearance between the underside of the lower track 20 and the top of the stock 6. To facilitate the movement of the two lower lengths of cable 14 a cable slide 33 (FIG. 8) is provided which has a pair of transverse slots 34-34 into which the two lower cables fit. The slide 33 is formed of a low friction material such as high density o ultra-high molecular weight polyethylene or another plastic having similar properties.

After the crossbow 5 has been cocked by drawing back the bow cable 32 over and behind the release pin 31 a short arrow such as indicated generally at 35 (FIGS. 5 and 7) is loaded from the muzzle end of the assembly 15. In order to move the arrow 35 to its fully rearward or loaded position an arrow retaining mechanism is manipulated and then released so that it engages the shaft of the arrow 35 with sufficient force to prevent the arrow from being dislodged by gravity or by movement of the loaded crossbow during aiming.

Figure 4:
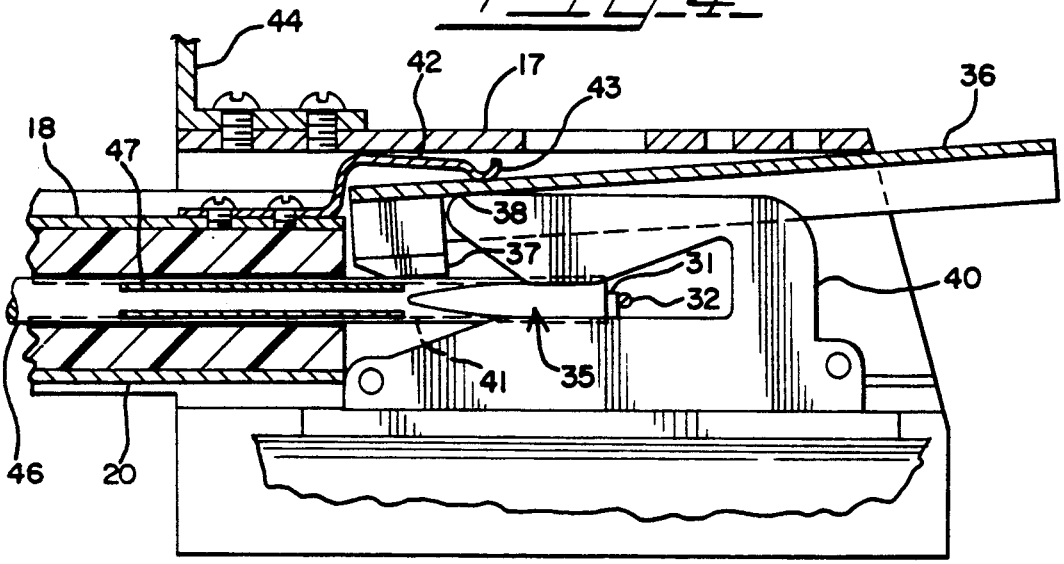
FIG. 4 is a fragmentary, partly broken-away view taken on line 4—4 of FIG. 3.

Referring to FIG. 4, the arrow release mechanism comprises an arrow hold lever 36 which has an arrow shaft engaging foot 37 projecting downwardly from the front end thereof. The front end of the lever 36 rests and pivots on a shoulder 38 of a member 40 forming a permanent part of the crossbow 5. The lever 36 is maintained and biased in its downwardly tilted position with the foot 37 engaging the shaft of the arrow 35 by means of a hold down spring 42. The proximal end of the spring 42 is mounted on the top side of the upper track 18 while its hook-shaped distal end 43 engages and presses down on the top of the lever 36. There is sufficient clearance between the tip of the formation 43 and the underside of the top of receiver 17 to allow the foot 37 to be raised by depressing the rear end of the lever 36 during loading of an arrow 35.

When a loaded arrow 35 with its nock end engaging the bow cable 32 is to be fired or shot from the crossbow 5, the archer will squeeze the trigger 10 in the usual manner whereupon the retainer pin 31 will be depressed or retracted and the arrow 35 will be propelled between the two guide strips 25 and 28 so as to launch it toward the target.

A rear peep sight 44 may be mounted on the top of the rear receiver 17 as shown. Alternatively, the peep sight 44 can be replaced by a telescopic sight mounted on the top of the receiver 17.

In use the short arrow kit 15 can be assembled and mounted on the crossbow 5 in approximately 5 minutes. It will be understood that the kit can also be removed and the crossbow restored to its original position for shooting conventional long arrows when desired. Instead of assembling and mounting the short arrow conversion kit 15 on the stock of a conventional crossbow, the short arrow system shown and described could be permanently incorporated in a crossbow as originally manufactured.

Referring to FIGS. 5–7, the arrow 35 comprises a pointed tip 45, a ferrule 46, and four blades or fins 47-47 which serve as the fletching for the arrow. The arrow tip 45 is preferably formed of steel and has a sharpened point when the arrow is used for hunting purposes. The profile of the sharpened point may be similar to the point of a Phillips screwdriver but somewhat more pointed and with sharpened edges 49-49 (FIG. 5). In a hunting arrow the sharpened point serves as a pilot for the sharpened end blades 47.

At its rear end, the arrow tip 45 has a stem 48 machined so as to have multi-sided raised integral rings (four shown) 50 with intermediate lands along the length thereof. The stem 48 fits into a socket 57 at the front end of the arrow ferrule 46. The arrow ferrule 46 is preferably formed by injection molding from a rigid but somewhat yieldable material such as glass-filled nylon or other plastic material having similar properties. The base edges of the triangular shaped blades 47 are molded into the arrow ferrule. In the case of a hunting arrow, the blades 47 are formed of razor steel and provided with razor sharp edges 61. The base edge of each blade 47 has a series of openings 62-62 into which plastic flows during molding so as to anchor each blade securely in place.

It has been found desirable that the blades 47 be disposed on the arrow shaft so that the acute angles therebetween (FIG. 3) are approximately 66 degrees making the obtuse angles therebetween approximately 114 degrees. In order to impart spin or rotation to the arrow 35 during flight, two of the aligned blades or fins 47 are provided on opposite sides with rotator tabs 63-63 which are formed during the formation of the ferrule 46 on opposite sides of the aligned blades as shown in FIGS. 3 and 6. It will also be seen from FIG. 3 that while the opposing arcuate surfaces of the arrow guide strips 25 and 28 engage the shaft of the arrow 30 the upper and lower tracks 18 and 20 provide unobstructed longitudinal spaces so that the blades 47 can pass through the assembly without encountering any obstruction.

What is claimed is:

1. A kit for assembly and attachment to a crossbow that will allow the crossbow to shoot arrows which are several times shorter than arrows of conventional length normally shot from the crossbow, comprising, a short arrow launching guide means mountable on the stock of the crossbow and having a muzzle end and a breach end, said breach end including a short arrow retention means that exerts a retention force on a short arrow loaded into said breach end sufficient to retain it in place against the force of gravity until the loaded and cocked crossbow is fired, a front clamp for mounting the muzzle end of said guide means on said crossbow stock and a rear receiver for mounting the breach end of said guide means on said crossbow stock, and wherein said guide means comprises elongated track means that provides low friction guide surfaces engageable by the shaft of an arrow as it is being launched and also provides open spaces allowing unobstructed passage of fletching on an arrow as it is being launched, said track means comprising an elongated outer support and interior elongated inserts formed of low friction material which provides low friction guide surfaces, said inserts being mounted within said outer elongated support and wherein said elongated outer support comprises an upper track and a lower track and an upper elongated low friction insert is mounted in said upper track and a lower elongated low friction support is mounted in said lower track.

2. In a crossbow for shooting arrows which are several times shorter than arrows of conventional length the improvement comprising a short arrow launching guide means forming the stock of the crossbow and having a muzzle end and a breach end and comprising elongated track means that provides low friction guide surfaces engageable by the shaft of an arrow as it is being launched and also provides open spaces allowing unobstructed passage of the fletching on an arrow as it is being launched, and a short arrow retention means that exerts a retention force on a short arrow loaded into said breach end sufficient to retain it in place against the force of gravity until the loaded and cocked crossbow is fired, and wherein said track means comprises an elongated outer support and interior elongated inserts formed with low friction guide surfaces, said elongated outer support comprising an upper track and a lower track and a upper elongated low friction insert is mounted in said upper track and a lower elongated low friction support is mounted in said lower track.

3. In the crossbow as claimed for in claim 2 wherein the upper and low tracks are symmetrical in cross-section and said upper and lower inserts are symmetrical whereby each of said upper and lower inserts has two arrow-engaging guide and wear surfaces.

4. An archery arrow comprising a shaft having a sharpened point at one end and a nock on the opposite end, and fletching consisting of blades located rearwardly of the center of gravity of the arrow, said blades having trailing edges and outer edges, at least two of said blades having rotator means disposed adjacent the trailing edges thereof so as to induce axial spin of the arrow in flight, wherein there are at least two opposed pairs of said blades and at least one pair of blades being diametrically opposed and having a pair of rotator inserts disposed inwardly from the outer edges of said blades and adjacent said shaft on opposite sides of the diameter extending through said blades.

5. A kit for assembly and attachment to a crossbow that will allow the crossbow to shoot arrows which are several times shorter than arrows of conventional length normally shot from the crossbow, comprising, a short arrow launching guide means mountable on the stock of the crossbow and having a muzzle end and a breach end, said breach end including a short arrow retention means that exerts a retention force on a short arrow loaded into said breach end sufficient to retain it in place against the force of gravity until the loaded and cocked crossbow is fired, a front clamp for mounting the muzzle end of said guide means on said crossbow stock and a rear receiver for mounting the breach end of said guide means on said crossbow stock, and wherein said guide means comprises elongated track means that provides low friction guide surfaces engageable by the shaft of an arrow as it is being launched and also provides open spaces allowing unobstructed passage of fletching on an arrow as it is being launched, said track means comprising an elongated outer support and interior elongated inserts formed with low friction guide surfaces, and wherein said elongated outer support comprises an upper track and a lower track and an upper elongated low friction insert is mounted in said upper track and a lower elongated low friction support is mounted in said lower track, said upper and lower track being symmetrical in cross-section and said upper and lower inserts being removable and symmetrical in cross-section whereby each of said inserts has two arrow-engaging guide and wear inserts.

6. A kit for assembly and attachment to a crossbow that will allow the crossbow to shoot arrows which are several times shorter than arrows of conventional length normally shot from the crossbow, comprising, a short arrow launching guide means mountable on the stock of the crossbow and having a muzzle end and a breach end, said breach end including a short arrow retention means that exerts a retention force on a short arrow loaded into said breach end sufficient to retain it in place against the force of gravity until the loaded and cocked crossbow is fired, a front clamp for mounting the muzzle end of said guide means on said crossbow stock and a rear receiver for mounting the breach end of said guide means on said crossbow stock, and wherein said guide means comprises elongated track means that provides low friction guide surfaces engageable by the shaft of an arrow as it is being launched and also provides open spaces allowing unobstructed passage of fletching on an arrow as it is being launched, said track means comprising an elongated outer support and interior elongated inserts formed with low friction guide surfaces, and wherein said elongated outer support comprises an upper track and a lower track and an upper elongated low friction insert is mounted in said upper track and a lower elongated low friction support is mounted in said lower track, said upper and lower tracks being symmetrical in cross-section and said upper and lower inserts being symmetrical in cross-section whereby each of said inserts has two arrow-engaging guide and wear inserts, and said upper and lower tracks have flanges extending from opposite sides thereof and said front clamp and rear receiver are generally inverted U-shaped and the sides thereof have interior grooves in which said flanges fit for support.

7. A kit for assembly and attachment to a crossbow that will allow the crossbow to shoot arrows which are several times shorter than arrows of conventional length normally shot from the crossbow, comprising, a short arrow launching guide means mountable on the stock of the crossbow and having a muzzle end and a breach end, said breach end including a short arrow retention means that exerts a retention force on a short arrow loaded into said breach end sufficient to retain it in place against the force of gravity until the loaded and cocked crossbow is fired, a front clamp for mounting the muzzle end of said guide means on said crossbow stock and a rear receiver for mounting the breach end of said guide means on said crossbow stock, and wherein said guide means comprises elongated track means that provides low friction guide surfaces engageable by the shaft of an arrow as it is being launched and also provides open spaces allowing unobstructed passage of fletching on an arrow as it is being launched, said track means comprising an elongated outer support and interior elongated inserts formed with low friction guide surfaces, and wherein said elongated outer support comprises an upper track and a lower track and an upper elongated low friction insert is mounted in said upper track and a lower elongated low friction support is mounted in said lower track, said upper and lower tracks being symmetrical in cross-section and said upper and lower inserts being symmetrical in cross-section whereby each of said inserts has two arrow-engaging guide and wear inserts, and each of said upper and lower tracks has interior formations providing a pair of spaced opposing flanges and each of said low friction inserts has a pair of side grooves in which said flanges fit.

8. A kit for assembly and attachment to a crossbow that will allow the crossbow to shoot arrows which are several times shorter than arrows of conventional length normally shot from the crossbow, comprising, a short arrow launching guide means mountable on the stock of the crossbow and having a muzzle end and a breach end, said breach end including a short arrow retention means that exerts a retention force on a short arrow loaded into said breach end sufficient to retain it in place against the force of gravity until the loaded and cocked crossbow is fired, a front clamp for mounting the muzzle end of said guide means on said crossbow stock and a rear receiver for mounting the breach end of said guide means on said crossbow stock, and wherein said guide means comprises elongated track means that provides low friction guide surfaces engageable by the shaft of an arrow as it is being launched and also provides open spaces allowing unobstructed passage of fletching on an arrow as it is being launched, and wherein, said front clamp and said receiver support said track means so as to provide a clearance between the underside of said track means and the top surface of said crossbow stock wherein a cable slide is disposed in said clearance and is engaged by the cable of said crossbow and slides on said top surface as said crossbow is cocked and fired.

9. The kit as called for in claim 8 wherein said cable slide has a pair of grooves in each of which one length of the crossbow cable is received.

10. A kit for assembly and attachment to a crossbow that will allow the crossbow to shoot arrows which are several times shorter than arrows of conventional length normally shot from the crossbow, comprising, a short arrow launching guide means mountable on the stock of the crossbow and having a muzzle end and a breach end, said breach end including a short arrow retention means that exerts a retention force on a short arrow loaded into said breach end sufficient to retain it in place against the force of gravity until the loaded and cocked crossbow is fired, a front clamp for mounting the muzzle end of said guide means on said crossbow stock and a rear receiver for mounting the breach end of said guide means on said crossbow stock, and wherein said guide means comprises elongated track means that provides low friction guide surfaces engageable by the shaft of an arrow as it is being launched and also provides open spaces allowing unobstructed passage of fletching on an arrow as it is being launched, and wherein said load arrow retention means comprises an arrow retention lever disposed within said receiver having an arrow shaft engaging shoe and a spring engaging said lever and biasing said shoe against the shaft of a loaded arrow.

11. The kit as called for in claim 10 wherein said arrow retention lever pivots rearwardly of and adjacent its said arrow shaft engaging shoe on a rigid part of said crossbow, and said spring is a leaf spring the distal end of which engages and holds said lever tilted down and biases said shoe in its lowered arrow shaft engaging position.

12. In a crossbow for shooting arrows which are several times shorter than arrows of conventional length the improvement comprising, a short arrow launching guide means forming the stock of the crossbow and having a muzzle end and a breach end and comprising elongated track means that provides low friction guide surfaces engageable by the shaft of an arrow as it is being launched and also provides open spaces allowing unobstructed passage of the fletching on an arrow as it is being launched, and a short arrow retention means that exerts a retention force on a short arrow loaded into said breach end sufficient to retain it in place against the force of gravity until the loaded and cocked crossbow is fired, and wherein said track means comprises an elongated outer support and interior elongated inserts formed with low friction guide surfaces, said elongated outer support comprising an upper track and a lower track and a upper elongated low friction insert is mounted in said upper track and a lower elongated low friction support is mounted in said lower track, and wherein said upper and lower tracks are symmetrical in cross-section and said upper and lower inserts are symmetrical in cross-section whereby each of said upper and lower inserts has two arrow-engaging guide and wear surfaces, and each of said upper and lower tracks has interior formations providing a pair of spaced opposing flanges and each of said low friction inserts has a pair of side grooves in which said flanges fit.

13. In a crossbow for shooting arrows which are several times shorter than arrows of conventional length the improvement comprising, a short arrow launching guide means forming the stock of the crossbow and having a muzzle end and a breach end and comprising elongated track means that provides low friction guide surfaces engageable by the shaft of an arrow as it is being launched and also provides open spaces allowing unobstructed passage of the fletching on an arrow as it is being launched, and a short arrow retention means that exerts a retention force on a short arrow loaded into said breach end sufficient to retain it in place against the force of gravity until the loaded and cocked crossbow is fired, and wherein said track means comprises an elongated outer support and interior elongated inserts formed with low friction guide surfaces, said elongated outer support comprising an upper track and a lower track and a upper elongated low friction insert is mounted in said upper track and a lower elongated low friction support is mounted in said lower track, and wherein said loaded arrow retention means comprises an arrow retention lever disposed within said receiver having an arrow shaft engaging shoe and a spring engaging said lever and biasing said shoe against the shaft of a loaded arrow.

14. In the crossbow as called for in claim 13 wherein said arrow retention lever pivots rearwardly of and adjacent its said arrow shaft engaging shoe on a rigid part of said crossbow, and said spring is a leaf spring the distal end of which engages and holds said lever tilted down and biases said shoe in its lowered arrow shaft engaging position.

* * * * *